US012091624B2

(12) United States Patent
Saroukhanian et al.

(10) Patent No.: US 12,091,624 B2
(45) Date of Patent: Sep. 17, 2024

(54) FUEL STABILIZER

(71) Applicant: HAPPYFUEL, LLC, Birmingham, MI (US)

(72) Inventors: Shant Saroukhanian, Birmingham, MI (US); Donato Polignone, Oakland, CA (US); Stephen Utschig-Samuels, Greeley, CO (US)

(73) Assignee: HAPPYFUEL, LLC, Birmingham, MI (US)

( * ) Notice: Subject to any disclaimer, the term of this patent is extended or adjusted under 35 U.S.C. 154(b) by 0 days.

(21) Appl. No.: 17/856,417

(22) Filed: Jul. 1, 2022

(65) Prior Publication Data

US 2023/0026685 A1 Jan. 26, 2023

Related U.S. Application Data

(60) Provisional application No. 63/218,693, filed on Jul. 6, 2021.

(51) Int. Cl.

| | |
|---|---|
| ***C10L 10/08*** | (2006.01) |
| ***C10L 1/16*** | (2006.01) |
| ***C10L 1/198*** | (2006.01) |
| ***C10L 10/04*** | (2006.01) |

(52) U.S. Cl.

CPC ..... *C10L 10/08* (2013.01); *C10L 1/1616* (2013.01); *C10L 1/1985* (2013.01); *C10L 10/04* (2013.01); *C10L 2200/0423* (2013.01); *C10L 2230/081* (2013.01); *C10L 2230/14* (2013.01); *C10L 2270/023* (2013.01)

(58) Field of Classification Search

CPC ..... C10L 10/08; C10L 1/1616; C10L 1/1985; C10L 10/04; C10L 2200/0423; C10L 2230/081; C10L 2230/14; C10L 2270/023

USPC ..... 585/3

See application file for complete search history.

(56) References Cited

U.S. PATENT DOCUMENTS

| | | | | |
|---|---|---|---|---|
| 5,509,944 | A | 4/1996 | Venkatadri et al. | |
| 6,326,336 | B1 | 12/2001 | Gatto et al. | |
| 6,652,608 | B1 | 11/2003 | Orr | |
| 7,572,303 | B2 | 8/2009 | Orr | |
| 7,964,002 | B2 | 6/2011 | Deblase et al. | |
| 7,964,003 | B2 | 6/2011 | Wicks | |
| 8,227,391 | B2 | 7/2012 | Ryan et al. | |
| 8,313,542 | B2 | 11/2012 | Deblase et al. | |
| 8,540,784 | B2 | 9/2013 | Siemssen et al. | |
| 8,927,472 | B2 | 1/2015 | Cholli et al. | |
| 9,523,060 | B2 | 12/2016 | Cholli et al. | |
| 9,546,341 | B2 | 1/2017 | Muir et al. | |
| 10,344,240 | B2 | 7/2019 | Fabre | |
| 10,479,953 | B2 | 11/2019 | Yeung et al. | |
| 2004/0060229 | A1 | 4/2004 | Todd et al. | |
| 2007/0204505 | A1 | 9/2007 | Abou-Nemeh | |
| 2010/0236140 | A1* | 9/2010 | Voelkel | C10L 1/221 564/503 |
| 2014/0033605 | A1* | 2/2014 | Sondjaja | C10L 1/143 44/442 |
| 2015/0011447 | A1* | 1/2015 | Waterson | C10L 10/14 585/24 |
| 2016/0326447 | A1 | 11/2016 | Podesta et al. | |
| 2019/0367835 | A1 | 12/2019 | Ransom | |

FOREIGN PATENT DOCUMENTS

| | | | |
|---|---|---|---|
| WO | 2017/054921 | A1 | 4/2017 |
| WO | 2020097423 | A1 | 5/2020 |

OTHER PUBLICATIONS

Canadian Office Action issued May 24, 2023 for CA Application No. 3,166,804, 4 pages.

* cited by examiner

*Primary Examiner* — Prem C Singh
*Assistant Examiner* — Francis C Campanell
(74) *Attorney, Agent, or Firm* — Brooks Kushman P.C.

(57) ABSTRACT

A fuel stabilizer formulation includes a hybrid component that acts as an antioxidant, a chelating agent, and lubricant when added to the fuel, one or more vapor suppressants, and a water scavenger. Furthermore, the formulation may include components that bond with gasoline compounds to prevent evaporation of low-end components, form a layer along with the engine metal that prevents condensed water from corroding the metal, prevent corroded metal ions from destabilizing gasoline compounds into resin, and scavenge water to prevent water deposits at the bottom of the tank which limits biological activity, resulting in an overall improvement in oxidation stability over conventional fuel stabilizers.

7 Claims, No Drawings

FUEL STABILIZER

CROSS-REFERENCE TO RELATED APPLICATION

This application claims the benefit of U.S. provisional application Ser. No. 63/218,693, filed Jul. 6, 2021, the disclosure of which is hereby incorporated in its entirety by reference herein.

TECHNICAL FIELD

The present application is directed to a stabilizing additive for fuel in vehicles.

BACKGROUND

As vehicles and devices with engines such as cars, boats, lawnmowers, snowblowers, and the like are stored in the off-season, fuel can remain in the tanks of these vehicles and devices over long periods of time (e.g., months at a time). Similarly, fuel such as jet fuel, diesel, and gasoline may be stored or transported in bulk, and may also be left in storage vessels over a long period of time.

Over time, fuel can oxidize and undergo other reactions that may subsequently cause issues when starting after the stagnant period/off-season, and may damage the fuel system or storage vessel/tank if left sitting idle for too long. Oxidation of fuel via reaction with atmospheric oxygen can result in the formation of reactive species, such as alcohols, aldehydes, ketones and carboxylic acids. These reactive species can further react with other fuel components and additives yielding unwanted fouling agents such as polymers in the form of varnishes, gums and sludges. Fuel is also affected by other environmental factors such as water content, surface area exposed to the atmosphere, exposure to sunlight, presence of microorganisms, prior processing of the fuel, exposure to free metals during transport or storage and the presence or absence of preservatives. The longer fuel is stored, the more likely it is that it will be exposed to these environmental factors, resulting in increasing potential for possible degradation of the fuel itself and possible damage to the vehicle.

Thus, fuel stabilizers may be added to the fuel in preparation for storage or the off-season. Adding a fuel stabilizer helps slow oxidation of the fuel and can help lengthen the time fuel can be stored, which can help save consumers money and frustration when the time comes to use their stored vehicles or equipment.

SUMMARY

In one or more embodiments, a fuel stabilizer includes a hybrid component having antioxidant, chelating agent, and lubricant properties; one or more vapor pressure suppressants; and a water scavenger component. The hybrid component may be 2,6-di-tert-butylphenol, and the water scavenger may be a glycol ether, such as 2-butoxy ethanol. The formulation may include 25 to 40% by weight of a hybrid component having an antioxidant, chelating agent, and lubricant properties; 20 to 45% by weight of one or more vapor pressure suppressants; and 20 to 30% by weight of a water scavenger component.

DETAILED DESCRIPTION

As required, detailed embodiments of the present invention are disclosed herein; however, it is to be understood that the disclosed embodiments are merely exemplary of the invention that may be embodied in various and alternative forms. Therefore, specific structural and functional details disclosed herein are not to be interpreted as limiting, but merely as a representative basis for teaching one skilled in the art to variously employ the present invention.

When a gas or diesel engine (e.g., engines in cars, boats, motorcycles, jet skis/wave runners, lawnmowers, chainsaws, snowmobiles, off-road vehicles, snow throwers, etc.) needs to be put in storage or away for the season or is going into a period of non-use for any period or length of time, the fuel in the system is subject to oxidation or other reactions which can not only lead to issues upon restart but issues within the fuel system. Users have limited options when storing their vehicles, equipment, and/or devices, such as, for example, draining fuel from the system upon storing. Draining fuel from the system is not only time-consuming but can be difficult to perform as engines and other systems are not readily designed to easily empty the fuel reservoirs.

As such, a conventional solution is to add a commercially available fuel stabilizer to the fuel reservoir to lengthen the life of the remaining fuel in the system upon storage. However, conventional fuel stabilizers may only have minimal impact on stability, may worsen oxidation stability (as tested using ASTM D525), or may only address singular concerns for fuel storage. Thus, a fuel stabilizer with improved performance is provided which addresses various factors in one or more embodiments.

There are commercially available products that claim to stabilize the fuel. When testing oxidation stability (using Anton Parr RapidOxy100) and using ASTM D525 test parameters, we learned that the most popular fuel stabilization products varied in performance, with some instances worsening the oxidation stability and some products having minimal impact. Although some products had positive results, our formula resulted in significant improvement in oxidation stability of gasoline when our formula was added to the gasoline, when compared to commercially available products. As such, the fuel stabilizer formula of the present application has the exhibited superior results when compared with the most popular commercially available fuel stabilizers, and exhibited the best oxidation stability when compared with other products on market (see Table 3 for comparative examples below).

According to one or more embodiments, a fuel stabilizer formulation is provided. The fuel stabilizer offers improvements in oxidation stability over conventional fuel stabilizers and includes components that bond with gasoline compounds to prevent evaporation of low-end components; form a layer along with the engine metal that inhibits condensed water from corroding the metal; inhibit corroded metal ions from destabilizing gasoline compounds into resin (which can hinder fuel injection components), and scavenge water to inhibit water deposits at the bottom of the tank which limits biological activity. As such, the fuel stabilizer formulation with the above-mentioned features includes at least one vapor pressure suppressant, at least one lubricant, at least one antioxidant and/or chelating agent, and at least one water scavenger component. The fuel stabilizer formulation addresses oxidation, lubrication, vapor pressure suppression, and water scavenging, thereby addressing the issues of fuel storage from all mechanistic ends.

According to one or more embodiments, the fuel stabilizer formulation generally comprises a hybrid component that acts as an antioxidant, a chelating agent, and lubricant when added to the fuel, one or more vapor suppressants, and a water scavenger. Each component will be described in further detail below. However, in at least one embodiment, the hybrid component is 2,6-di-tert-butylphenol (sold commercially as HiTEC 4733), in one or more embodiments, the vapor suppressants may be petroleum distillates (hydrotreated heavy paraffinic, hydrotreated light, etc.), petroleum solvent naphtha (heavy aromatic, light aromatic, etc.), isoparaffinic solvent, synthetic fluids from a gas-to-liquid (GTL) process, etc., or combinations thereof. In at least one embodiment, the vapor suppressant is an isoparaffinic hydrocarbon solvent such as, for example, Solvent 142, Isopar L, Isopar M, or combinations thereof, and in one or more embodiments, the water scavenger may be a glycol ether such as, for example, 2-butoxy ethanol (commercially available as Downaol EB sold by Dow Chemical Company) In at least one embodiment, the formulation includes 33% by weight of 2,6-di-tert-butylphenol; 23% by weight Solvent 142; 18% by weight Isopar M; and 26% by weight 2-butoxy ethanol. Hereinafter, percentage by weight is referenced as composition based on total weight.

In one or more embodiments, the fuel stabilizer formulation includes at least one vapor pressure suppressant to prevent the loss of low-end hydrocarbons from the fuel. Low-end hydrocarbons help keep formed polymers in the fuel more soluble and the fuel less viscous, thus it is advantageous to the overall stability to prevent the low-end hydrocarbons from evaporating. In older equipment and older vehicles requiring long-term fuel storage, evaporating of these low-end hydrocarbons is of particular issue due to the caps and seals of the tanks often being less robust than modern caps and seals such that more low-end hydrocarbons can evaporate. Furthermore, storage in warm climates can exacerbate evaporation. When low-end hydrocarbons evaporate from the fuel composition, the pressure in the tank is increased and the volatilized components can leak out from the seals and caps. As storage temperatures eventually decrease, the pressure inside the tank falls and draws in air in order to equilibrate, thereby introducing both oxygen and water into the tank. The vapor pressure suppressant of the fuel stabilizer formulation may be, but is not limited to, Solvent 142, Isopar L, Isopar M, or combinations thereof. The vapor pressure suppressant of the fuel stabilizer formulation is included in the fuel stabilizer at 5 to 75% by weight in certain embodiments, 10 to 60% by weight in other embodiments, and 15 to 50% by weight in yet other embodiments. In an embodiment, the vapor pressure suppressant may be included in the fuel stabilizer at 23% by weight, and in yet another embodiment 41% by weight.

In one or more embodiments, the vapor pressure suppressant may include at least one acyclic aliphatic compound and at least one cyclic aliphatic compound, wherein at least one cyclic aliphatic compound comprises one or more -dimethyl or -trimethyl branched alkanes with -cyclopentyl or-cyclohexyl rings in the range of 30-90% by weight and at least one acyclic aliphatic compound containing a carbon change length in the range of $C_9$ to $C_{15}$ in the range of 10-70% by weight.

Thus, example formulas are provided in Table 1 below, with the percent composition shown by weight. These formulas are examples of possible combinations of a fuel stabilizer. The following formulas were prepared to test the effectiveness of the fuel stabilizer as compared to untreated 87 octane unleaded gasoline, as well as other competitor formulas, as will be discussed in the Experimental Results.

TABLE 1

| | Commercially Sold By | % By Weight |
|---|---|---|
| Formula 1 | | |
| HiTEC ® 4733 Fuel Additive | Chempoint | 2.000% |
| Solvent 142 | | 45.000% |
| Isopar M | Exxon | 45.000% |
| BioExtend 30HP Antioxidant | Eastman | 8.000% |
| Formula 2 | | |
| HiTEC ® 4733 Fuel Additive | Chempoint | 2.000% |
| Solvent 142 | | 30.000% |
| Isopar M | Exxon | 30.000% |
| Downaol EB | Dow, etc. | 30.000% |
| BioExtend 30HP Antioxidant | Eastman | 8.000% |
| Formula 3 | | |
| HiTEC ® 4733 Fuel Additive | Chempoint | 20.000% |
| Solvent 142 | | 20.000% |
| Isopar M | Exxon | 15.000% |
| Downaol EB | Dow, etc. | 25.000% |
| BioExtend 30HP Antioxidant | Eastman | 20.000% |
| Formula 4 | | |
| HiTEC ® 4733 Fuel Additive | Chempoint | 33.000% |
| Solvent 142 | | 23.000% |
| Isopar M | Exxon | 18.000% |
| Downaol EB | Dow, etc. | 26.000% |
| Formula 4-1 | | |
| HiTEC ® 4733 Fuel Additive | Chempoint | 33.000% |
| Solvent 142 | | 23.000% |
| Isopar M | Exxon | 16.000% |
| Downaol EB | Dow, etc. | 24.000% |
| IPA 99% | | 4.000% |
| Formula 5 | | |
| HiTEC ® 4733 Fuel Additive | Chempoint | 44.000% |
| Solvent 142 | | 15.000% |
| Isopar M | Exxon | 15.000% |
| Downaol EB | Dow, etc. | 26.000% |

In at least one embodiment, the fuel stabilizer formulation includes one or more lubricants. In certain embodiments, the vapor pressure suppressant or suppressants or the antioxidant component may act dually as a lubricant for the fuel stabilizer. Being larger molecules than the low-end hydrocarbon components, they not only solubilize the low-end hydrocarbons to prevent the low-end hydrocarbons from evaporating, but the vapor pressure suppressant structures can be designed in a way that allows the functional groups to form a boundary layer between the storage tank and the other fuel components. Methyl, dimethyl and trimethyl iso-groups, as well as cyclohexyl and cyclopentyl side chain groups, can fit into the storage tanks metal asperities, thereby preventing absorbed water from settling into these high charge density areas that are particularly vulnerable to corrosion. However, the fuel stabilizer formulation in certain embodiments may include a separate lubricant component in addition to the presence of the vapor pressure suppressant component or the antioxidant component, regardless of whether they individually exhibit dual properties. The lubricant of the fuel stabilizer formulation is included in the fuel stabilizer at least 1% by weight in certain embodiments, 1% to 35% by weight in other embodiments, and 2% to 30% by weight in yet other embodiments. In an embodiment, the lubricant may be included in the fuel stabilizer at 3% to 25% by weight.

In at least one embodiment, the fuel stabilizer formulation may include a corrosion inhibitor to prevent vulnerable areas of the storage tank from corroding. The corrosion inhibitor may be included in any suitable quantity, in some embodiments 1% to 35% by weight of the fuel stabilizer, in other embodiments 2% to 30% by weight, and in yet further embodiments, 3% to 25% by weight.

Additionally, in one or more embodiments, the fuel stabilizer formulation includes at least one antioxidant to limit the reactivity of atmospheric oxygen with the fuel. The antioxidant component may also dually serve as a chelating agent (and may be interchangeably referred to as a chelating agent) and may also provide lubricant properties for the stabilizer as previously discussed. The antioxidant may be a suitable non-corrosive and non-hydrolyzable antioxidant. In certain embodiments, the antioxidant is 2,6-di-tert-butylphenol (which is commercially available as HiTec 4733 as sold by Afton Chemical Corporation). The antioxidant is included in the fuel stabilizer from 10 to 90% by weight, in some embodiments, 25 to 40% by weight in yet other embodiments, and 30 to 35% by weight in yet other embodiments. In an example, the antioxidant is 33% by weight of the fuel stabilizer. In further examples, 2,6-di-tert-butylphenol may be included as at least 2% of the fuel stabilizer, along with one or more other antioxidants.

The presence of antioxidants in the fuel may act as reducing agents for reactive metal cations for the free metals to which the fuels may have been exposed in prior processing, transport, or storage. These and newly formed corrosion products may also contain free metals which exacerbate the instability of the fuel over time. For example, fully oxidized metal cations can attract formed fouling agents and cause them to agglomerate. As such, the antioxidants described above can help keep these free metal ions in their reduced state for as long as possible by preventing free radical reactions involved in oxidation, thereby reducing gum formation and extending the overall fuel stability.

Furthermore, many conventional fuel stabilizing antioxidants are highly susceptible to hydrolysis. Water, which is inevitably absorbed into the fuel as a result of environmental factors, reacts with many antioxidants, changing their composition and limiting or eliminating their ability to function as antioxidants. The use of a non-hydrolyzable antioxidant is critical to the longevity of the fuel, as to prevent the formation of gums during storage.

Additionally, contact with air introduces reactive oxygen as well as water from the atmosphere. When fuels are stored in climates with higher relative humidity, fuel components that are naturally hygroscopic inevitably absorb water into the fuel itself. Reaction with water results in the hydrolysis of ester groups causing an increase in the acid value of the bulk composition. Increased acid value can increase the corrosion potential of the fuel. Water is also an integral component in facilitating biological growth. As microbial organisms produce and utilize enzymes in their normal metabolic pathways, these organisms digest fuels resulting in detrimental changes in the bulk composition (sludge formation). Therefore, the use of a water scavenger (drying agent) is necessary.

Thus, in one or more embodiments, the fuel stabilizer formulation includes at least one water scavenging agent in order to remove and/or deactivate water from the fuel to avoid unfavorable side reactions in the fuel and corrosion or fouling of fuel filters. Appropriate water scavengers must 1) react exclusively with water, 2) be combustible as both scavenger and a by-product of the water scavenging reaction so that both scavenger and water can leave the fuel system, 3) be sufficiently hydrophobic to be soluble in and therefore protect the fuel, yet the product of the reaction with water must be sufficiently hydrophilic to preferentially partition into residual water to perform the scavenging mechanism. The —OH groups of selected scavengers form Hydrogen bonds with water impurities, allowing water to become bound into the overall combustion product as opposed to settling on the bottom of the tanks where it can contribute to corrosion. Water scavenging agents may include alcohol, glycol, or glycol ether or combinations thereof. The water scavenging agent may be included in the fuel stabilizer in certain embodiments at 10 to 60% by weight, in other embodiments, 15 to 50% by weight, and in yet further embodiments, 20-40% by weight.

Table 2 includes additional examples of formulas, with the components listed by weight.

TABLE 2

| | % By Weight |
|---|---|
| Formula 1 | |
| 2,6-di-tert-butylphenol | 2.00% |
| Solvent 142 | 45.00% |
| Isopar M | 45.00% |
| Antioxidant (for example, BioExtend 30HP Antioxidant solution, sold by Eastman Chemical Co. and includes e.g., diethylene glycol monobutyl ether; 2-tert-butylhydroquinone; ethylene glycol monobutyl ether; 2,2'-[(1-methyl-1,2-ethanediyl)bis(nitrilomethylidyne)]bis-phenol) | 8.00% |
| Formula 6 | |
| 2,6-di-tert-butylphenol | 2.00% |
| Solvent 142 | 30.00% |
| Isopar M | 30.00% |
| Diethylene glycol monobutyl ether | 3.36% |
| 2-tert-butylhydroquinone | 2.40% |
| ethylene glycol monobutyl ether | 32.16% |
| 2,2'-[(1-methyl-1,2-ethanediyl)bis(nitrilomethylidyne)]bis-phenol | 0.08% |
| Formula 7 | |
| 2,6-di-tert-butylphenol | 20.00% |
| Solvent 142 | 20.00% |
| Isopar M | 15.00% |
| Diethylene glycol monobutyl ether | 8.40% |
| 2-tert-butylhydroquinone | 6.00% |
| ethylene glycol monobutyl ether | 30.40% |
| 2,2'-[(1-methyl-1,2-ethanediyl)bis(nitrilomethylidyne)]bis-phenol | 0.20% |
| Formula 4 | |
| 2,6-di-tert-butylphenol | 33.00% |
| Solvent 142 | 23.00% |
| Isopar M | 18.00% |
| 2-butoxy ethanol | 26.00% |

The fuel stabilizer may be added to gasoline (e.g., unleaded gasoline fuel) in any suitable amount to increase the oxidation stability. For example, the fuel stabilizer may be added to achieve a volume ratio of gasoline to fuel stabilizer of at least 300:1, in other embodiments, at least 400:1, and in some embodiments, 400:1 to 500:1. 2he fuel stabilizer exhibits an improvement in stability over conventional stabilizers and over untreated fuel by inclusion of the fuel stabilizer in the untreated fuel (e.g., gasoline). The fuel stabilizer may be included as a volume ratio of fuel to stabilizer of at least 200:1 in certain embodiments, at least 300:1 in other embodiments, and at least 400:1 in yet other embodiments. In at least one embodiment, the volume ratio of fuel to stabilizer may be 300:1 to 500:1, and in yet further embodiments 400:1 to 500:1. In one or more embodiments, the fuel stabilizer may be included as at least 0.10 ml per 50 ml of fuel in certain embodiments, 0.10 ml to 0.50 ml of stabilizer per 50 ml of fuel in other embodiments, and in yet further embodiments, 0.12 ml to 0.40 ml of stabilizer per 50 ml of fuel. The fuel stabilizer may be added via a dropper (e.g., a 0.03 to 0.05 ml dropper), and may include 1 to 10 drops in certain embodiments of fuel stabilizer per 50 ml of fuel. By including the fuel stabilizer, the performance of the fuel under ASTM Test D525 can be improved (as a measure of minutes to failure) to at least 500 minutes in one or more embodiments. The fuel stabilizer may be dosed in some embodiments, from 0.1 oz/gal of gasoline to 2 oz/gal of gasoline, in other embodiments 0.15 oz/gal to 1.85 oz/gal, and in yet further embodiments, 0.20 oz/gal to 1.75 oz/gal.

As many conventional fuel stabilizers focus on the use of antioxidants and on preventing the oxidation of the fuel itself to prolong the life, the longer the fuel is stored the more antioxidants in the formulation may be depleted. Furthermore, conventional fuel additives only focus on the lubrication aspect of fuel storage, and do not address other environmental factors that cause degradation of the fuel. As such, according to various embodiments, a fuel stabilizer is provided that provides a wholly encompassing mechanistic approach to combatting oxidation as well as the inevitable reaction products that may be formed following depletion, which may be accelerated by unavoidable environmental factors. By including the various components described above, a fuel stabilizer with improved performance in fuel stability is achieved.

Experimental Results

The example formulations of the fuel stabilizer disclosed herein improve the oxidation stability over untreated gasoline by at least 50%. One of the formulations of the fuel stabilizer added at showed a 111.80% improvement over untreated 87 octane unleaded gasoline when added at a volume ratio of 278:1. The results of the ASTM D525 tests between the formulas disclosed herein and in the below Tables versus untreated gasoline showed that the formulations described herein resisted oxidation longer than the control (untreated gasoline), as well as resisted oxidation longer than other existing commercial products when used at comparative dosages; meaning that fuel treated with our formulation (e.g., Formula #1) resists evaporation of low-end fractions more effectively, suggesting that the formulation performed as a superior vapor pressure reducer 2) resists oxidation longer due to better-performing antioxidants in our formula, and 3) thereby resists formations of gums for longer, as a result. Comparative examples are provided below in Table 3, and results of a comparison with untreated gasoline vs. a gasoline including a fuel stabilizer according to Formula #4 is provided in Table 4.

TABLE 3

| TEST NAME | FUEL | GRADE | ADDITIVE | ADDITIVE VOLUME RATIO | RECALC VOLUME RATIO | MIN. TO FAILURE | PERCENTAGE IMPROVEMENT |
|---|---|---|---|---|---|---|---|
| t001_19 | Meijer 1/1 fuel sample | 87 | none | NA | | 399 | |
| t001_20 | Meijer 1/1 fuel sample | 87 | none | NA | | 393 | |
| t001_21 | Meijer 1/1 fuel sample | 87 | Formula 4 | 300:1 | 500:1 | 513 | 29.55% |
| t001_22 | Meijer 1/1 fuel sample | 87 | Formula 4 | 200:1 | 333:1 | 530 | 33.84% |
| t001_23 | Meijer 1/1 fuel sample | 87 | Competitor 2 | 320:1 (per label) | | 512 | 29.29% |
| t001_24 | Meijer 1/1 fuel sample | 87 | Competitor 1 | 128:1 (per label) | | 413 | 4.29% |
| t001_25 | Meijer 1/1 fuel sample | 87 | Formula 4 | 100:1 | 167:1 | 562 | 41.92% |
| t001_26 | Racing Fuel | 110 | none | NA | | 906 | |
| E_7 | Sunoco 1/7/21 | 93 | none | NA | | 521 | |
| E_8 | Sunoco 1/7/21 | 93 | none | NA | | 633 | |
| E_9 | Sunoco 1/7/21 | 93 | Formula 5 | 200:1 | 333:1 | 657 | 7.18% |
| E_10 | Sunoco 1/7/21 | 93 | Formula 5 | 300:1 | 500:1 | 687 | 12.07% |
| E_11 | Sunoco 1/7/21 | 93 | none | NA | | 678 | |
| E_12 | Sunoco 1/7/21 | 93 | Competitor 2 | 320:1 | | 670 | 9.30% |
| E_13 | Sunoco 1/7/21 | 93 | Formula 4 | 200:1 | 333:1 | 676 | 10.28% |
| E_14 | Sunoco 1/7/21 | 93 | Formula 4 | 300:1 | 500:1 | 687 | 12.07% |
| E_15 | Sunoco 1/7/21 | 93 | none | NA | | 618 | |
| E_16 | meijer 1/27 sample | 87 | none | NA | | 335 | |
| E_17 | meijer 1/27 sample | 87 | none | NA | | 309 | |
| E_18 | meijer 1/27 sample | 87 | Formula 5 | 200:1 | 333:1 | 521 | 61.80% |

TABLE 3-continued

| TEST NAME | FUEL | GRADE | ADDITIVE | ADDITIVE VOLUME RATIO | RECALC VOLUME RATIO | MIN. TO FAILURE | PERCENTAGE IMPROVEMENT |
|---|---|---|---|---|---|---|---|
| E_19 | meijer 1/27 sample | 87 | Formula 5 | 300:1 | 500:1 | 560 | 73.91% |
| E_20 | meijer 1/27 sample | 87 | Formula 4 | 200:1 | 333:1 | 574 | 78.26% |
| E_21 | meijer 1/27 sample | 87 | Formula 4 | 300:1 | 500:1 | 561 | 74.22% |
| E_22 | meijer 1/27 sample | 87 | Competitor 2 | 320:1 | | 557 | 72.98% |
| E_23 | meijer 1/27 sample | 87 | none | NA | | 371 | 15.22% |
| E_24 | meijer 1/27 sample | 87 | Competitor 3 | 384:1 | | 302 | −6.21% |
| E_25 | meijer 1/27 sample | 87 | Competitor 2 | 320:1 | 5 drops | 537 | 66.77% |
| E_26 | meijer 1/27 sample | 87 | Formula 4 | 555:1 | 3 drops | 569 | 76.71% |
| E_27 | meijer 1/27 sample | 87 | Competitor 4 | 128:1 | 13 drops | 309 | −4.04% |
| E_28 | meijer 1/27 sample | 87 | Competitor 4 | 256:1 | 6.5 drops | 298 | −7.45% |
| E_29 | meijer 1/27 sample | 87 | Formula 4 | 416:1 | 4 drops | 568 | 76.40% |
| E_30 | meijer 1/27 sample | 87 | Formula 4 | 278:1 | 6 drops | 682 | 111.80% |
| E_31 | meijer 1/27 sample | 87 | Formula 4 | 185:1 | 9 drops | 558 | 73.29% |

TABLE 4

| Result Data Untreated Gasoline: Anton Paar RapidOxy 100 | | Result Data Treated with Formula 4: Anton Paar RapidOxy 100 | 5 ml gasoline treated with concentration with Formula 4 |
|---|---|---|---|
| Serial number | 60077134 | Serial number | 60077134 |
| Instrument software version | 1.03.1378.136 | Instrument software version | 1.03.1378.136 |
| Sample Name | Sample E_17 | Sample Name | Sample E_21 |
| Date and time | Feb. 1, 2021 8:53:14 AM | Date and time | Feb. 3, 2021 9:24:39 AM |
| User | Administrator | User | Administrator |
| Program: | | Program: | |
| Program name | Fuel stabilizer | Program name | Fuel stabilizer |
| Program type | User program | Program type | User program |
| Start temperature | 68.0° F. | Start temperature | 68.0° F. |
| Filling pressure | 100.00 psi | Filling pressure | 100.00 psi |
| Target temperature | 212.0° F. | Target temperature | 212.0° F. |
| Purging | Standard 1x | Purging | Standard 1x |
| Stop criterion | | Stop criterion | |
| Pressure drop | 2.00 psi | Pressure drop | 2.00 psi |
| Cooling temperature | 68.0° F. | Cooling temperature | 68.0° F. |
| Result | | Result | |
| Status | OK | Status | OK |
| Pressure drop result | 2.01 psi at 309.65 min | Pressure drop result | 2.01 psi at 561.40 min |
| Test duration result | OK | Test duration result | OK |
| Condition | — | Condition | — |
| Emergency | — | Emergency | — |
| Total runtime | 309.65 min | Total runtime | 561.40 min |
| Average temperature | 212.0° F. | Average temperature | 212.0° F. |
| Max. temperature | 212.6° F. | Max. temperature | 212.6° F. |
| Pressure at start | 99.43 psi | Pressure at start | 99.29 psi |
| Max. pressure | 180.68 psi | Max. pressure | 181.83 psi |
| Pressure at stop | 178.67 psi | Pressure at stop | 179.82 psi |
| Pressure difference | 2.01 psi | Pressure difference | 2.01 psi |

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. As used herein, the term "about" means that the amount or value in question may be the specific value designated or some other value in its neighborhood. Generally, the term "about" denoting a certain value is intended to denote a range within +/−5% of the value. As one example, the phrase "about 100" denotes a range of 100+/−5, i.e. the range from 95 to 105. Generally, when the term "about" is used, it can be expected that similar results or effects according to the invention can be obtained within a range of +/−5% of the indicated value.

It should also be appreciated that integer ranges (e.g., for measurements or dimensions) explicitly include all intervening integers. For example, the integer range 1-10 explicitly includes 1, 2, 3, 4, 5, 6, 7, 8, 9, and 10. Similarly, the range 1 to 100 includes 1, 2, 3, 4, . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

In the specific examples set forth herein, concentrations, temperature, and reaction conditions (e.g. pressure, pH, flow rates, etc.) can be practiced with plus or minus 50 percent of the values of the examples indicated, rounded to or truncated to three significant figures. In a refinement, concentrations, temperature, and reaction conditions (e.g., pressure, pH, flow rates, etc.) can be practiced with plus or minus 30 percent of the values indicated rounded to three significant FIGURES of the value provided in the examples. In another refinement, concentrations, temperature, and reaction conditions (e.g., pressure, pH, flow rates, etc.) can be practiced with plus or minus 10 percent of the values indicated rounded to three significant FIGURES of the value provided in the examples.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended aspects, the singular form "a," "an," and "the" comprise plural referents unless the context clearly indicates otherwise. For example, reference to a component in the singular is intended to comprise a plurality of components.

As used herein, the term "and/or" means that either all or only one of the elements of the said group may be present. For example, "A and/or B" shall mean "only A, or only B, or both A and B". In the case of "only A", the term also covers the possibility that B is absent, i.e. "only A, but not B".

The term "one or more" means "at least one" and the term "at least one" means "one or more." The terms "one or more" and "at least one" include "plurality" as a subset.

The term "substantially," "generally," or "about" may be used herein to describe disclosed or claimed embodiments. The term "substantially" may modify a value or relative characteristic disclosed or claimed in the present disclosure. In such instances, "substantially" may signify that the value or relative characteristic it modifies is within ±0%, 0.1%, 0.5%, 1%, 2%, 3%, 4%, 5% or 10% of the value or relative characteristic.

Unless expressly stated to the contrary, all R groups (e.g., Ri where i is an integer) include hydrogen, alkyl, lower alkyl, $C_{1-6}$ alkyl, $C_{6-10}$ aryl, $C_{6-10}$ heteroaryl, —$NO_2$, —$NH_2$, —N(R'R"), —N(R'R"R"')$^+$L$^-$, Cl, F, Br, —$CF_3$, —$CCl_3$, —CN, —$SO_3H$, —$PO_3H_2$, —COOH, —$CO_2R'$, —COR', —CHO, —OH, —OR', —$O^-M^+$, —$SO_3^-M^+$, —$PO_3^-M^+$, —$COO^-M^+$, —$CF_2H$, —$CF_2R'$, —$CFH_2$, and —CFR'R" where R', R" and R"' are $C_{1-10}$ alkyl or $C_{6-18}$ aryl groups, $M^+$ is a metal ion, and $L^-$ is a negatively charged counter ion; single letters (e.g., "n" or "o") are 1, 2, 3, 4, or 5; in the compounds disclosed herein a CH bond can be substituted with alkyl, lower alkyl, $C_{1-6}$ alkyl, $C_{6-10}$ aryl, $C_{6-10}$ heteroaryl, —$NO_2$, —$NH_2$, —N(R'R"), —N(R'R"R"')$^+$L", Cl, F, Br, —$CF_3$, —$CCl_3$, —CN, —$SO_3H$, —$PO_3H_2$, —COOH, —$CO_2R'$, —COR', —CHO, —OH, —OR', —$O^-M^+$, —$SO_3^-M^+$, —$PO_3^-M^+$, —$COO^-M^+$, —$CF_2H$, —$CF_2R'$, —$CFH_2$, and —CFR'R" where R', R" and R"' are $C_{1-10}$ alkyl or $C_{6-18}$ aryl groups, W is a metal ion, and L" is a negatively charged counter ion; when a given chemical structure includes a substituent on a chemical moiety (e.g., on an aryl, alkyl, etc.) that substituent is imputed to a more general chemical structure encompassing the given structure; percent, "parts of," and ratio values are by weight; the term "polymer" includes "oligomer," "copolymer," "terpolymer," and the like; molecular weights provided for any polymers refers to weight average molecular weight unless otherwise indicated; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fuel stabilizer formulation consisting of:

25 to 40% by weight of a hybrid component having antioxidant, chelating, and lubricant properties;

20 to 30% by weight of a first vapor pressure suppressant comprising a mixed paraffinic naphthenic solvent;

15 to 25% by weight of a second vapor pressure suppressant comprising an isoparaffinic hydrocarbon fluid; and 20 to 30% by weight of a water scavenger component.

2. The fuel stabilizer formulation of claim 1, wherein the hybrid component is 2,6-di-tert-butylphenol.

3. The fuel stabilizer formulation of claim 1, wherein the water scavenger component is a glycol ether.

4. The fuel stabilizer of claim 3, where the glycol ether is 2-butoxy ethanol.

5. The fuel stabilizer of claim 1, wherein inclusion of the fuel stabilizer in gasoline improves a time to failure of the gasoline to at least 500 minutes relative to untreated gasoline, as tested by ASTM D525 when included at a volume ratio of the gasoline to fuel stabilizer of 300:1 to 500:1.

6. The fuel stabilizer of claim 1, wherein inclusion of the fuel stabilizer in gasoline improves an oxidation stability of the gasoline by at least 50% relative to untreated gasoline when included at a volume ratio of the gasoline to fuel stabilizer of 300:1 to 500:1, as measured by time to oxidation by ASTM D525.

7. The fuel stabilizer formulation of claim 1, wherein the hybrid component comprises 2,6-di-tert-butylphenol and is present in an amount of 33% by weight, based on the weight of the fuel stabilizer formulation; the first vapor pressure suppressant is present in an amount of 23% by weight; the second vapor pressure suppressant is present in an amount of 18% by weight; and the water scavenger component comprises 2-butoxy ethanol and is present in an amount of 26% by weight.

* * * * *